United States Patent [19]

Waldock

[11] Patent Number: 4,959,108

[45] Date of Patent: Sep. 25, 1990

[54] EXPLOSIVE COMPOSITIONS AND METHOD UTILIZING BULKING AND GASSING AGENTS

[75] Inventor: Kevin H. Waldock, Wales, Australia

[73] Assignee: Submarine and Surface Blaster PTY Limited, Mount Thorley, Australia

[21] Appl. No.: 357,282

[22] Filed: May 26, 1989

[30] Foreign Application Priority Data

May 26, 1988 [AU] Australia ..... PI8506

[51] Int. Cl.[5] ..... C06B 45/00

[52] U.S. Cl. ..... 149/2; 149/21; 149/109.6

[58] Field of Search ..... 149/2, 109.6, 21

[56] References Cited

U.S. PATENT DOCUMENTS 4,872,929 10/1989 Mullay ..... 149/2

*Primary Examiner*—Stephen J. Lechert, Jr.

*Attorney, Agent, or Firm*—Birch, Stewart, Kolasch & Birch

[57] ABSTRACT

This invention relates to a method of preparing an explosive composition which comprises adding an inert bulking agent to said explosive composition, so as to increase the weight and density thereof, and thereafter introducing gas into said composition, so as to decrease said density to at least 1.1 g/cc. The invention also provides an explosive composition which comprises an inert bulking agent which is added to the composition to increase the weight and density thereof, and further includes gas which is thereafter added to lower the density to a predetermined or desired level.

10 Claims, No Drawings

EXPLOSIVE COMPOSITIONS AND METHOD UTILIZING BULKING AND GASSING AGENTS

This invention relates to explosive compositions including watergel, slurry and emulsion compositions, and to methods of forming and using same.

In many forms of explosive compositions used up until this time, both active and inert ingredients have been mixed together and inserted or loaded into bore holes. Thereafter the explosive compositions have been detonated.

In using exposives, bore holes are often drilled in strata or rock, such bore holes being drilled for example vertically or inclined. The bottom of the bore hole is referred to and known as the 'toe' of the hole. The generally central or elongate part of the bore hole is generally known as the 'body' of the bore hole. The upper area or top of the bore hole is known as the 'collar'.

It is generally accepted in the explosives industry, and among those using explosives such as for example, in the mining and excavation industries, that the work done by an explosive at the 'toe' of the bore hole is greater than the work done in the 'body' and 'collar' areas of the bore hole.

At this point in time, it is known at relatively common for the same explosive composition to be loaded into the 'toe' of a bore hole as is loaded into the 'body' of the bore hole. Thus, on detonation, more energy is supplied to the 'body' of the hole than is necessary to break the middle and top of the bore hole. Thus, in order to achieve a better distribution of energy from the detonation and explosion in such situations, it is known to load a higher energy composition in the 'toe' area, than in the 'body' area of the bore hole. This mode of loading explosive compositions into bore holes is known as 'combination loading'.

In order to achieve relatively successful 'combination loading', various methods have been used for adjusting or varying the energy at different parts of the bore hole. For example, in some cases high energy additives have been used. This has been done relatively successfully. Further, methods have been successfully used which employ the use of high density explosives in the 'toe', with separate low density explosives in the 'body'.

The result of such 'combination loading', allows for a relatively high energy conventional blast in the 'toe' of the bore hole, such as to break the burden in the 'toe' of the bore hole. The lower energy top loading, caused by the reduced density in the 'body' of the bore hole lowers the bulk energy on detonation; that is to say, the explosive fills and acts over more of the bore hole than does a comparable weight of explosive in the bottom load at the 'toe' of the hole.

In conventional blasting which does not employ 'combination loading', and where the same explosive has been used throughout the hole, (that is in both the 'toe' and over the 'body'), the explosive energy at the 'toe' was sufficient and desirable, whereas the explosive energy in the 'body' of the bore hole was greater than required. Detonation of such loads results in over-fragmentation at the top of the hole coupled with 'back break' into new material causing instablity in the high wall area. Further, such use of explosive energy is inefficient where the greater energy provided over the 'body' of the bore hole is unnecessary. The use of less explosives in the bore hole does not of itself reduce the overbreak in the 'body' of the hole, but does cause oversize material on the top of the blast.

It is an object of the present invention to provide an explosive composition and methods of forming and/or using an explosive composition which overcome or at least minimise one or more of the problems outlined above.

It is a further object of this invention to provide a straightforward and efficient explosive composition and a straightforward and efficient method of forming and using an explosive composition.

Other objects of this invention will become apparent from the following description.

According to one aspect of this invention there is provided a method of preparing an explosive composition, comprising adding an inert bulking agent to said composition so as to increase weight and density thereof and thereafter introducing gas so as to decrease said density.

According to a further aspect of this invention there is provided a method of preparing an explosive composition, comprising adding an inert bulking agent to said composition so as to increase the weight and density thereof, and thereafter introducing gas so as to decrease said density to at least 1.1 g/cc.

According to a further aspect of this invention there is provided a method of preparing an explosive composition, comprising adding an inert bulking agent to said composition so as to increase weight and density thereof, and thereafter adding or introducing gas, so as to decrease the density of said composition to between 1.1 g/cc and 1.3 g/cc.

According to a further aspect of this invention there is provided an explosive composition comprising an inert bulking agent added to increase weight and density of said composition and further including gas to thereafter lower said density to a predetermined or desired level.

According to a further aspect of this invention there is provided an explosive composition comprising an inert bulking agent added to increase the weight and density of said composition and further including gas introduced to thereafter decrease said density to at least 1.1 g/cc.

According to a further aspect of this invention there is provided an explosive composition comprising an inert bulking agent added to initially increase weight and density of said composition and further including gas, thereafter introduced to lower said density to between 1.1 g/cc and 1.3 g/cc.

This invention will now be described by way of example only but it should be appreciated that improvements and modifications may be made to the invention without departing from the scope or spirit thereof.

The present invention has application to watergel slurry and emulsion explosive compositions, although it should be kept in mind that when the invention applies to compositions to be used in wet bore holes, the density of the resultant composition should be greater than at least 1.1 g/cc to ensure that the composition has sufficient weight and will not float in the bore hole water.

The explosive composition of the present invention, formed by the method of the present invention, allows for detonation resulting in a substantially low density top load, the results being that fragmentation of rock is more uniform because of better energy distribution, and 'back break' being reduced at the 'collar' of the bore hole due to reduced bore hole pressure. Detonation of the explosive composition of the present invention, within bore holes, results in reduced bore hole pressure. Further, environmentally, lower bore hole pressure lowers the noise from the blast on decimation.

In a preferred form, the explosive composition of the present invention is used in an essentially 'combination load' manner, with a standard explosive being loaded into the 'toe' of the bore hole, while explosive composition according to the present invention is loaded into the remainder of the bore hole. If desired however, the explosive composition of the present invention could be used over the whole length of the bore hole.

The present invention essentially sets out to provide an explosive composition whereby the density of the composition can be lowered so as to modify the detonation characteristics of the composition, and additionally be loaded into a bore hole under water.

The lowering of the density of the explosive composition will result in the explosive column being higher in the bore hole, so that the explosive can act over a greater length of the bore hole. The lower density will also lower the bore hole pressure, reducing the 'back break', stabilising the high wall and lowering adverse environmental factors such as noise, which result from blasts using compositions available at this point in time.

It should be appreciated that when the present invention is used in wet holes, the composition must be adjusted so that the density is at least 1.1 g/cc and preferably higher (for example between 1.1 g/cc and 1.3 g/cc), to ensure that the composition will not float in the bore hole water.

The present invention has application to all known commercial slurry watergels and emulsion and emulsion-containing products. Explosive compositions may for example be mixtures of oxidisers, fuels and sensitisers, which may include for example bulking agents, finely divided metals and liquid or solid molecular explosives (such as for example TNT, smokeless powder, methyl amine nitrates, ethanol amine nitrite and the like).

In the present invention slurry watergel explosives and emulsions would include normal compositions containing ammonium nitrate, calcium nitrate and sodium nitrate, and perchlorates of sodium and ammonia. By way of example, these oxiders and sensitisers could be solid or dissolved in a solvent such as, but not limited to, water and alcohols. The fuels and fuel sensitisers may include for example fuel oil and other distillate products, paraffins, waxes, resins and pitches, water soluble fuels such as glycols, alcohols, amines and amine salts. Also if desired organic thickeners such as starches, gums, polyacrylamides, sawdust, wood pulp and wood extracts or by-products. Additionally, they may use emulsifiers which are used to stabilise water-in-oil emulsion or crystal habit modifiers. The above are by way of example only.

In the method of the present invention, the composition is formed by adding to an explosive composition an appropriate inert material or combination of inert materials, which may for example be styrene beads, glass beads, sand or other mineral fillers or the like. The above are by way of example only.

In the preferred form of the invention the inert material, being added as inert bulking agents, have a bulk density of from 1.1 to 4.0 g/cc.

The inert bulking agent is added to the composition to increase the weight and density thereof, so that in particular the composition has sufficient weight to avoid floating in wet bore holes. Following the addition of the inert bulking agent, gas is introduced or added to the composition so as to thereafter reduce the density of the composition as a whole and to increase the volume thereof. The gas is introduced so as to reduce the density to at least 1.1 g/cc and preferably between 1.1 g/cc and 1.3 g/cc.

The reduction of the density of the composition, (and the increase in the volume thereof), by the introduction of gas, lowers the density so as to meet the objects of the present invention and to allow the composition, on detonation, to have a lower bore hole pressure and results in a more evently distributed explosive force over the length of the bore hole.

There now follow, by way of example only, examples of explosive compositions according to the preferred form of the invention.

EXAMPLE NO. 1

In this example a watergel explosive was taken such as that knnown as GX-20 (trade mark). Further, approximately 3 mm glass beads were taken, the glass beads having a bulk density of approximately 1.51 g/cc and a particle size of approximately 2.48 g/cc. Approximately 80% (by weight) explosive composition and 20% (by weight) glass beads were mixed together, this resulting in the bulk density and weight of the explosive composition being increased. For example being increased to between approximately 1.30 g/cc and 1.40 g/cc. Thereafter gas was introduced to the composition including the glass beads, and the density of the composition was reduced to approximately 1.2 g/cc.

EXAMPLE NO. 2

In this example the watergel explosive GX-20 (trade mark) was again taken. Further, glass beads of 650–800 microns were taken, these beads having a bulk density of approximately 1.49 g/cc and a particle size of approximately 2.50 g/cc. The glass beads were added to the explosive composition so that the resultant composition comprised of approximately 80% (by weight) watergel explosive and approximately 20% (by weight) glass beads. This increased the weight of the composition and the density thereof to between approximately 1.38–1.40 g/cc. Gas was then introduced into the composition to reduce the density of the composition to 1.2 g/cc.

EXAMPLE NO. 3

In this example the same watergel explosive GX-20 (trade mark) was taken. To this explosive composition was added a bulk filler or inert building agent in the form of Ilminite. The resultant composition was 80% (by weight) watergel exposive and 20% (by weight) Ilminite. The Ilminite had a bulk density of 2.54 g/cc. In this example, the addition of the Ilminite increased the density of the composition to approximately 1.38 g/cc to 1.43 g/cc. Thereafter gas was introduced to the composition to reduce the density to approximately 1.2 g/cc.

EXAMPLE NO. 4

In this example an emulsion explosive composition was used. To the emulsion composition was added an inert bulking agent in the form of glass beads of 650–800 microns. The resultant composition was 78% (by weight) emulsion composition and 20% (by weight) glass beads. The addition of the glass beads increased the density of the composition and thereafter gas was introduced to lower the density of the composition to approximately 1.25 g/cc.

The above examples are by way of example only and it should be appreciated that this invention has been described by way of example only and that modifications and improvements may be made thereto without departing from the scope or spirit thereof as defined by the appended claims.

I claim:

1. A method of preparing an explosive composition, comprising adding an inert bulking agent to said composition so as to increase weight and density thereof and thereafter introducing gas so as to decrease said density.

2. A method as claimed in claim 1 wherein said gas is introduced to decrease said density to at least 1.1 g/cc.

3. A method as claimed in claim 1, wherein gas is added or introduced, so as to decrease density of said composition to between 1.1 g/cc and 1.3 g/cc.

4. A method as claimed in claim 1, wherein said inert material includes one or more of styrene beads, glass beads, and/or mineral fillers.

5. A method as claimed in claim 1, wherein the inert material in the form of one or more of styrene beads, glass beads, sand and/or mineral fillers has a bulk density of from 1.1 to 4.0 g/cc.

6. An explosive composition comprising an inert bulking agent added to increase weight and density of said composition and further including gas to thereafter lower said density to a predetermined or desired level.

7. An explosive composition as claimed in claim 6, including gas introduced to thereafter decrease said density to at least 1.1 g/cc.

8. An explosive composition as claimed in claim 6, including an inert bulking agent added to initially increase weight and density of said composition and further including gas, thereafter introduced to lower said density to between 1.1 g/cc and 1.3 g/cc.

9. An explosive composition as claimed in claim 6, wherein said inert material is one or more of styrene beads, glass beads, sand and/or mineral fillers.

10. An explosive composition as claimed in claim 6, wherein said inert material added as a bulking agent, has a bulk density of from 1.1 to 4.0 g/cc.

* * * * *